United States Patent [19]

White

[11] Patent Number: 4,855,643

[45] Date of Patent: Aug. 8, 1989

[54] UNSATURATED VAPOR PRESSURE TYPE HIGH PRESSURE SODIUM LAMP

[75] Inventor: Philip J. White, Georgetown, Mass.

[73] Assignee: GTE Products Corporation, Danvers, Mass.

[21] Appl. No.: 274,656

[22] Filed: Nov. 21, 1988

Related U.S. Application Data

[63] Continuation of Ser. No. 473,895, Mar. 10, 1983, abandoned.

[51] Int. Cl.[4] ..... H01J 61/26

[52] U.S. Cl. ..... 313/553; 252/181.6

[58] Field of Search ..... 313/549, 553, 558, 559, 313/561, 562; 417/48; 252/181.6, 181.1, 181.3

[56] References Cited

U.S. PATENT DOCUMENTS

| | | | |
|---|---|---|---|
| 3,203,901 | 8/1965 | Della Porta | 352/181.6 |
| 3,248,590 | 4/1966 | Schmidt | 313/570 |
| 3,453,477 | 7/1969 | Hanneman et al. | 313/184 |
| 3,485,343 | 12/1969 | Jorgensen | 313/559 X |
| 4,075,530 | 2/1978 | Furukubo et al. | 313/318 X |
| 4,558,963 | 1/1971 | Hanneman et al. | 313/184 |

FOREIGN PATENT DOCUMENTS

| | | | |
|---|---|---|---|
| 53-101874 | 9/1978 | Japan | 313/558 |
| 56-162447 | 12/1981 | Japan | 313/549 |
| 1211175 | 11/1970 | United Kingdom . | |
| 1211176 | 11/1970 | United Kingdom . | |

*Primary Examiner*—Kenneth Wieder

*Attorney, Agent, or Firm*—Thomas H. Buffton; Martha Ann Finnegan

[57] ABSTRACT

An unsaturated vapor pressure high pressure sodium lamp includes an arc tube positioned within an evacuated glass envelope and containing a gas fill including mercury and sodium and a getter having a free energy of formation per mole of oxygen more negative than that of sodium oxide.

12 Claims, 2 Drawing Sheets

UNSATURATED VAPOR PRESSURE TYPE HIGH PRESSURE SODIUM LAMP

This ia a continuation of co-pending application Ser. No. 473,895 filed on Mar. 10, 1983, now abandoned.

CROSS REFERENCE TO OTHER APPLICATIONS

Concurrently filed applications entitled "Unsaturated Vapor High Pressure Sodium Lamp Arc Tube Fabricating Process," bearing Attorney's Docket No. 83-1-036, U.S. Ser. No. 473,894, abandoned and "Unsaturated Vapor High Pressure Sodium Lamp Getter Mounting," bearing Attorney's Docket No. 83-1-021, U.S. Ser. No. 473,897, abandoned relate to an arc tube fabricating process and getter mounting structure for high pressure sodium lamp. Also, concurrently filed applications entitled "Arc Tube Fabrication Process," bearing Attorney's Docket No. 24,833, U.S. Ser. No. 473,896, abandoned and "Arc Tube Dosing Process For Unsaturated High Pressure Sodium Lamps," bearing Attorney's Docket No. 24,517, U.S. Ser. No. 473,892, abandoned relate to arc tube fabrication and arc tube dosing of unsaturated vapor type high pressure sodium lamps.

TECHNICAL FIELD

This invention relates to high pressure sodium lamps of the unsaturated vapor pressure type and more particularly to an unsaturated vapor pressure type high pressure sodium lamp having an arc tube containing a fill gas and a getter in contact with the fill gas.

BACKGROUND ART

High pressure sodium lamps, and particularly so-called "saturated" high pressure sodium lamps, are known in the art. Therein, an elongated art tube is positioned within an evacuated glass envelope and filled with large amounts of sodium and mercury. As is well known, sodium loss has long been a problem causing undesired increased voltage drop across the lamp and an accompanying reduction in the useful period of "life" of the discharge lamp. Thus, the large amount or "saturated" sodium content of the arc tube is an attempt to compensate for the uncontrolled loss of sodium during the operational use of the discharge lamp.

It has long been recognized that one of the principal causes for this undesired sodium loss is the presence of oxygen impurities in the gas fill of the arc tube. More specifically, it is known that the sodium fill gas tends to combine with oxygen and the aluminum oxide arc tube to provide sodium aluminate whereby undesired sodium loss is encountered.

One known attempt to reduce this undesired oxygen impurity level is set forth in U.S. Pat. No. 4,075,530 of Furukubo et al. Therein, a niobium exhaust pipe is coupled to an arc tube and a decomposable material, NaN3, is located within the exhaust pipe. The exhaust pipe is heated to decompose the NaN3 while the art tube is cooled to effect condensation. Thus, the material within this exhaust pipe is heated to effect decomposition, transferred to the arc tube wherein materials, such as sodium and mercury, are condensed and whereat undesired gases, such as nitrogen, are withdrawn.

Unfortunately, locating the decomposable materials in a container external to the arc tube necessitates the application of heat thereto in order to effect the desired decomposition. Thereafter, the decomposed materials must be transferred to the arc tube. Also, the arc tube must be cooled in order to effect the condensation of desired residual materials while permitting the exhaust of other undesired materials. Obviously, such a process is cumbersome of apparatus and unrealistically expensive of labor and materials.

OBJECTS AND SUMMARY OF THE INVENTION

An object of the invention is to provide an enhanced high pressure sodium lamp. Another object of the invention is to provide an unsaturated high pressure sodium lamp. Still another object of the invention is to improve stability of an unsaturated type high pressure sodium lamp. A further object of the invention is to reduce the loss of sodium in an unsaturated vapor high pressure sodium lamp.

These and other objects, advantages and capabilities are achieved in one aspect of the invention by an unsaturated vapor pressure type high pressure sodium lamp having an elongated arc tube located within an evacuated glass envelope and containing a fill including mercury and sodium and a getter forming a metal oxide having a free energy of formation per mole of oxygen more negative than the free energy of formation per mole of oxygen of sodium oxide.

BEST MODE FOR CARRYING OUT THE INVENTION

For a better understanding of the present invention, together with other and further objects, advantages and capabilities thereof, reference is made to the following disclosure and appended claims in connection with the accompanying drawings.

Figure 1:
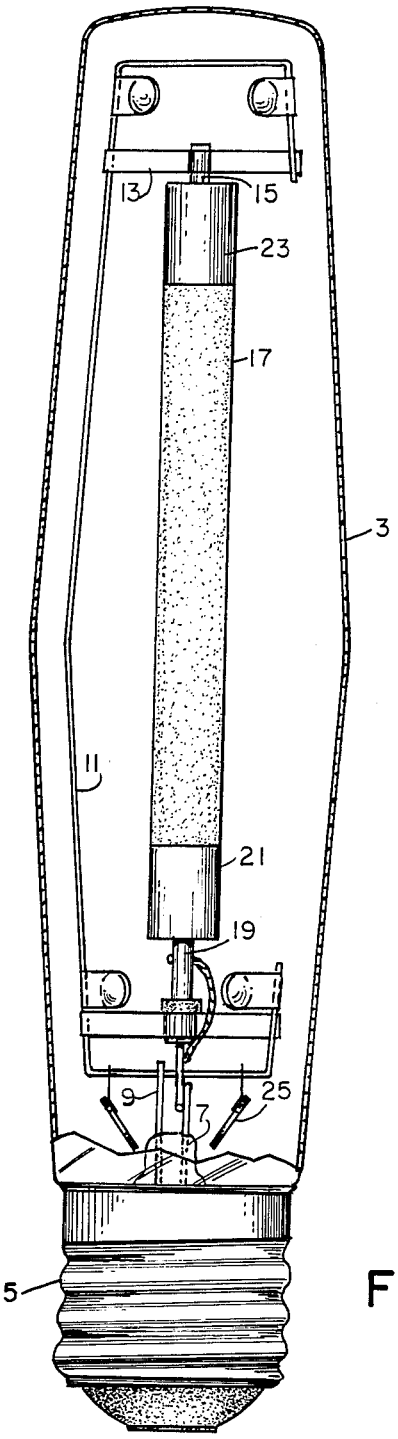
FIG. 1 is an elevational perspective view of a high pressure sodium lamp of the unsaturated vapor type of the invention.

Referring to the drawings, FIG. 1 illustrates an unsaturated vapor pressure high pressure sodium lamp of the invention. Herein, a glass envelope 3 is formed for insertion in a normal screw-type metal base 5. A stem portion 7 of glass is hermetically sealed to the glass envelope 3 and extends therein. The stem portion 7 has a plurality of electrical conductors 9 sealed therein and extending therethrough. An electrically conductive support member 11 is affixed to one of the electrical conductors 9 and to a metal cross-member 13 attached to an electrode 15 at one end of an elongated arc tube 17. Another electrode 19 is located at the opposite end of the arc tube 17 and attached to one of the electrical conductors 9 passing through the stem portion 7. Heat insulating sleeves 21 and 23 are wrapped about the opposite ends of the arc tube 17 in the vicinity of the electrodes 19 and 15 respectively. Also, the glass envelope is evacuated and at least one gtter, preferably barium, 25 is positioned adjacent the stem portion 7.

Further, a lamp fill including sodium and mercury is disposed within the arc tube 17 in an amount only sufficient to provide an unsaturated vapor type high pressure sodium lamp. Importantly, a getter forming a metal oxide having a free energy of formation per mole of oxygen more negative than sodium oxide and more positive than aluminium oxide is located within the art tube 17. The getter is in direct contact with the fill gas and preferably adjacent one of the electrodes 15 and 19 within the art tube 17.

The getter is of a material which does not react with mercury or sodium but does react with oxygen at a rate greater than the rate of reaction of sodium with oxygen. Also, the getter has a melting temperature greater than the operational end temperature of the arc tube 17. Moreover, a preferred getter is a zirconium-aluminum alloy getter manufactured by SAES Getters S.P.A., Milan, Italy, and known by the trade name St 101 getter having an alloy containing about 84% zirconium and 16% aluminum.

As a specific example, a number of substantially identical 400-watt unsaturated vapor high pressure sodium lamps were fabricated. Each of the lamps included an arc tube 17 of a polycrystalline aluminum oxide material having an inner volume of about 4.3 cubin centimeters. Each of the arc tubes 17 contained a relatively low amount of sodium, about $6\times10^{-5}$ gms, and one of the arc tubes 17 included about 10 mgs of the above-described zirconium-aluminum getter material.

Figure 2:
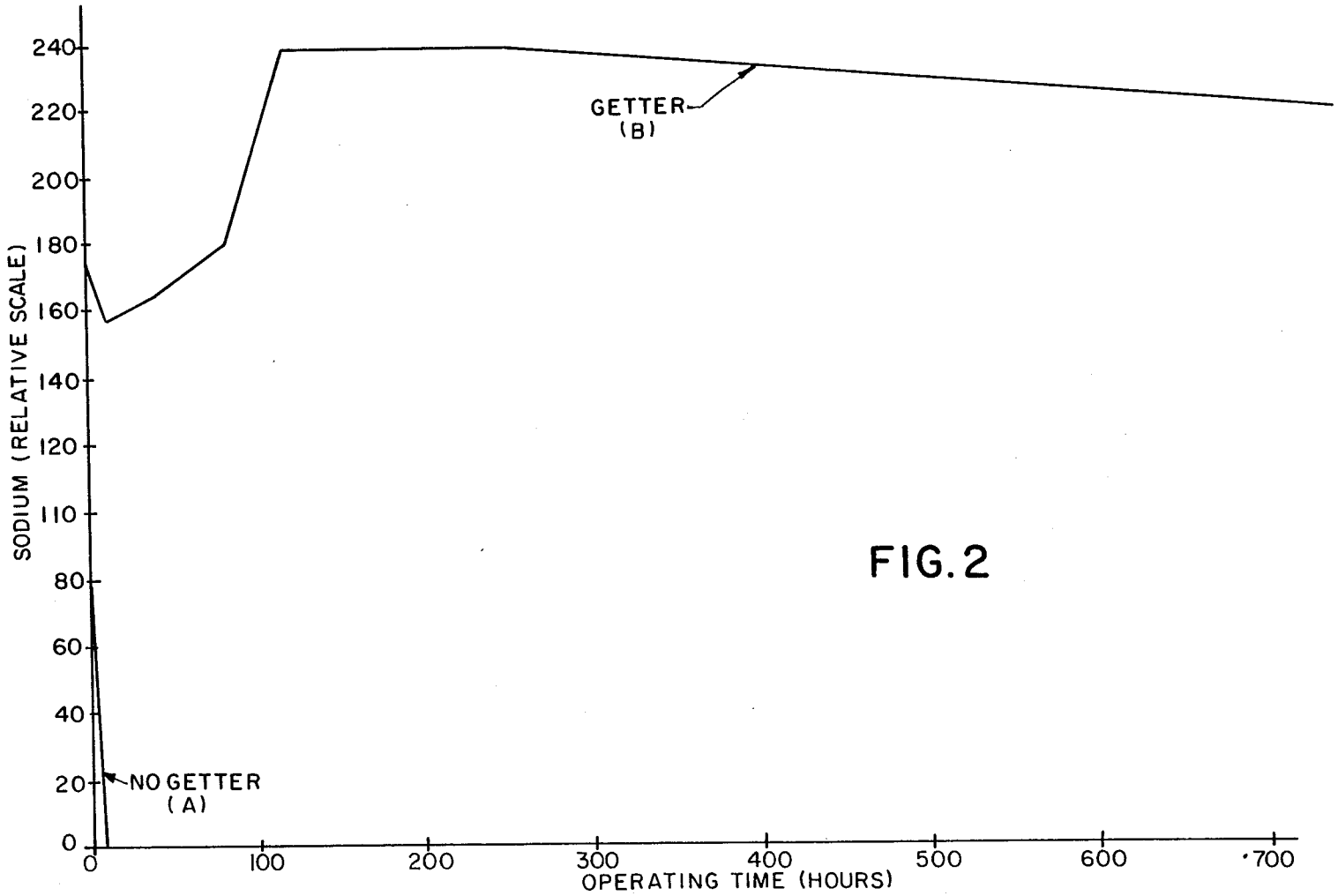
FIG. 2 is a chart comparing relative sodium content with operational time for unsaturated high pressure sodium lamps with and without a getter therein.

All of the lamps were processed in a substantially similar manner and lamps with and without the above-mentioned getter located within the arc tube 17 were energized under substantially normal operating conditions. As can readily be seen from the comparison chart of FIG. 2, the lamp having no getter (Curve "A") within the arc tube 17 lost essentially all of the sodium therein through arc tube wall reaction within a period of less than five (5) hours. On the other hand, the lamp having an arc tube 17 containing a getter (Curve "B"), as previously described, indicates a good supplyof sodium after an operating period greater than about 700 hours.

Thus, a high pressure sodium lamp employing an unsaturated vapor pressure has been provided wherein a getter is positioned within the arc tube of the lamp. The arc tube has a relatively low amount of sodium introduced therein, and the getter forms a metal oxide with a more negative free energy of formation than that of sodium oxide. As a result, the sodium level of the arc tube is maintained and the period of operational use of the lamp is extended as compared with prior known structures.

While there has been shown and described what is at present considered the preferred embodiments of the invention, it will be obvious to those skilled in the art that various changes and modifications may be made therein without departing from the invention as defined by the appended claims.

What is claimed is:

1. An unsaturated vapor pressure high pressure sodium lamp comprising:

an evacuated glass envelope having a plurality of electrically conductive support members therein and extending therethrough;

an elongated arc tube having a pair of electrodes extending therethrough and affixed to said electrically conductive support members within said glass envelope;

a gas fill including mercury and sodium within said elongated arc tube; and a getter located within said arc tube in contact with said gas fill and providing a metal oxide having a free energy of formation per mole of oxygen more negative than the free energy of formation per mole of oxygen of sodium oxide.

2. The unsaturated high pressure sodium lamp of claim 1 wherein said getter is in the form of a zirconium-aluminum alloy getter.

3. The unsaturated high pressure sodium lamp of claim 1 wherein said getter is non-reactive with mercury and sodium.

4. The unsaturated high pressure sodium lamp of claim 1 wherein said getter is in the form of an alloy including about 84% zirconium and 16% aluminum.

5. The unsaturated high pressure sodium lamp of claim 1 wherein said arc tube has a given operational end temperature and said getter has a melting point at a temperature higher than said given operational end temperature of said arc tube.

6. The unsaturated vapor high pressure sodium lamp of claim 1 wherein said getter material reacts with oxygen at a rate greater than the rate of reaction of sodium with oxygen.

7. The unsaturated high pressure sodium lamp of claim 1 wherein said arc tube has a volume of about 4.3 cubic centimeters and contains about $6\times10^{-5}$ gms of sodium and about 10-mgs of 84% zirconium 16% aluminum getter.

8. In a high pressure sodium lamp of the unsaturated vapor type having an elongated arc tube with a pair of electrodes extending therethrough and supported by electrical conductors within an evacuated glass envelope, the improvement comprising a fill gas including mercury and sodium and a getter providing a metal oxide having a free energy of formation per mole of oxygen more negative than the free energy of formation per mole of oxygen of sodium oxide disposed within said arc tube.

9. The improvement of claim 8 wherein said getter is in the form of a zirconium and aluminum alloy.

10. The improvement of claim 8 wherein said getter is in direct contact with said fill gas within said elongated arc tube.

11. The improvement of claim 8 wherein said getter reacts with oxygen at a rate greater than the reaction rate of sodium with oxygen.

12. The improvement of claim 8 wherein said getter includes about 84% zirconium and about 16% aluminum.

* * * * *